United States Patent [19]

Pfetzing

[11] 4,204,307

[45] May 27, 1980

[54] ARROW FLETCHING METHOD

[76] Inventor: Rodger E. Pfetzing, 1700 Melton, Birmingham, Mich. 48008

[21] Appl. No.: 919,429

[22] Filed: Jun. 26, 1978

[51] Int. Cl.[2] ..... B23Q 17/00; B23P 17/00; B23P 11/02

[52] U.S. Cl. ..... 29/407; 29/418; 29/450; 264/328; 273/423; 425/468

[58] Field of Search ..... 29/450, 407, 418; 273/106.5 C; 425/468; 264/328

[56] References Cited

U.S. PATENT DOCUMENTS

| | | | |
|---|---|---|---|
| 2,887,319 | 5/1959 | Lay | 273/106.05 C |
| 3,051,774 | 8/1962 | Schelke | 425/468 X |
| 3,093,432 | 6/1963 | King | 425/468 X |
| 3,165,788 | 1/1965 | Davidson | 425/468 X |
| 3,366,995 | 2/1968 | Dijken et al. | 425/468 X |
| 3,595,579 | 7/1971 | Benoit | 273/106.05 C |
| 3,815,916 | 6/1974 | Meszaros | 273/106.5 C |

FOREIGN PATENT DOCUMENTS

| | | | |
|---|---|---|---|
| 1148138 | 12/1957 | France | 273/106.5 C |
| 477821 | 1/1938 | United Kingdom | 273/106.5 C |

*Primary Examiner*—Charlie T. Moon
*Attorney, Agent, or Firm*—Krass & Young

[57] ABSTRACT

A new design for a unitary arrow fletching facilitates both OEM and replacement fletching. The fletching includes two annular forms which supply gripping means to pull the fletching onto an arrow shaft. These annular forms are then removed.

The mold for the fletching has a central core rod which is supported by pins extending thereto from the external walls of the mold cavity. The pins support the core rod during the molding process. In OEM production the fletching may be molded directly on to the arrow shaft.

3 Claims, 8 Drawing Figures

ARROW FLETCHING METHOD

BACKGROUND OF THE INVENTION

1. Field of the Invention.

This invention relates to fletching arrows used in the practice of archery.

2. Description of Prior Art.

Feathers or sections of feathers are traditionally used for fletching arrows. Their use requires trimming to size, aligning and fastening to the arrow shaft. These steps are generally carried out by hand. This makes the arrow fletching process slow, tedious and expensive. Substitution of semi-rigid plastic films for the feather sections gives rise to the same difficulties.

The problems are similar for those who wish to repair arrows with damaged fletchings. It is difficult to find someone who has the apparatus and will refletch arrows at a reasonable price. As a result of this, many archers discard arrows with damaged fletches.

Prior attempts to remedy these problems utilized plastic unitary fletching such as disclosed in the patent to Lay U.S. Pat. No. 2,887,319. In the unitary fletching the vanes are connected to a cylindrical body which slips over the arrow shaft. The fletching is light weight, and it is difficult to gain purchase on the plastic fletching and pull it onto the shaft without severely distorting it. Once it is on the shaft, straightening out any twists and careful positioning are almost impossible because of the snug fit of the cylindrical body over the arrow shaft.

In the fletching of OEM arrows the assembling of a plastic unitary fletching onto the arrow shaft is still a hand operation. If one were to attempt to mold the fletching directly onto the arrow shaft, further problems would arise. Tremendous pressure is required to force the fluent plastic into the small and narrow sections of the mold cavity. This pressure is so great that it would immediately collapse a hollow cylindrical aluminum arrow shaft. Even if the arrow shaft were solid, or if it had a support core inside of it, the force exerted by the plastic moving under high pressure would tend to bend the shaft off of true center.

SUMMARY OF THE INVENTION

This invention relates to a unitary plastic arrow fletching design which greatly facilitates production and assembly. The arrow fletching has two annular forms one at each end of the cylindrical body which facilitate the hand assembly of the fletching onto the arrow shaft. The same annular forms can then be used to straighten out any twists or convolutions in the vanes. After assembly these annular forms are cut off and removed.

For OEM production the fletching may be molded directly onto the arrow shaft supported by a support rod. This is possible because extending from the mold sections through the mold cavity are pins which give support to the central core rod of the mold and prevent it from deforming off center. Knurling prevents the fletching from slipping off the arrow shaft in use.

DESCRIPTION OF THE PREFERRED EMBODIMENTS

The use of the same number in different figures indicates the same assembly or part.

Figure 1:
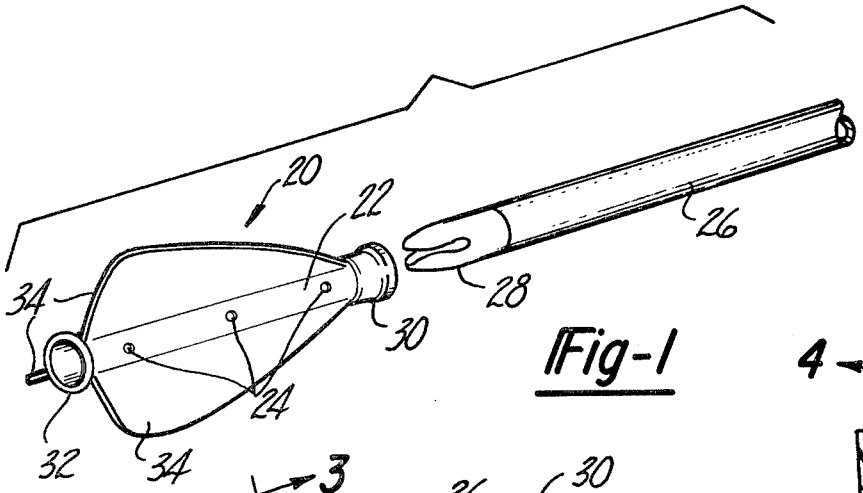
FIG. 1 shows the fletching of this invention about to be mounted onto an arrow shaft.

FIG. 1 shows a unitary fletching device of this invention 20 about to be assembled onto an arrow shaft 26. The rearward end of the arrow shaft has a nock 28 attached thereto.

The fletching 20 comprises a hollow cylindrical body 22 which fits snugly over the arrow shaft 26. The cylindrical body contains perforations 24 which result from the molding process and will be described in more detail later. At either end of the cylindrical body are the concentric annular forms 30 and 32. These can be used as gripping means for pulling the cylindrical body 22 onto the arrow shaft 26. One concurrently pulls the forward annular form 30 onto the arrow shaft and pushes the rearward annular form 32. Pulling on the forward annular form 30 tends to lengthen the cylindrical body and decrease its diameter, making it more difficult to mount the fletching. Pushing on the rearward annular form 32 counters this tendency. Once mounted the forward and rearward annular forms are gripped and twisted to straighten out any distortions of the vanes 34 which occur during mounting.

Figure 2:
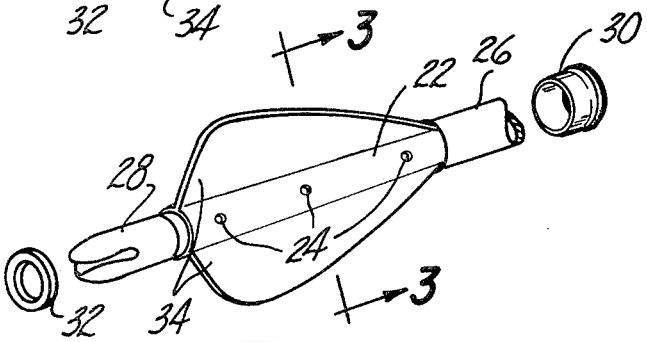
FIG. 2 shows the fletching of this invention after mounting on an arrow shaft and after removal of the two annular forms.

FIG. 2 shows the fletching device 20 of FIG. 1 after it has been assembled on the arrow shaft 26. The forward and rearward annular forms 30 and 32 have been removed to leave the fletching in its finished form. The holes 24 in the cylindrical body 22 are a phenomenon of the molding process. The nock 28 fits onto the bow string which, when drawn back and released gives the arrow assembly its power for flight.

The functional parts of the fletching are the vanes 34 which stabilize the arrow in its flight.

Figure 3:
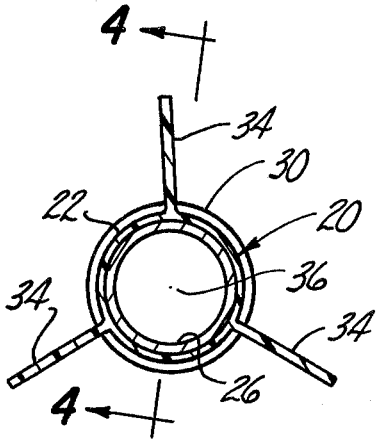
FIG. 3 shows a cross-section of the assembly of FIG. 2 taken along the line 3—3.

FIG. 3 is a cross-section of a fletching mounted on an arrow. The forward concentric annular form 30 has not yet been removed. The fletching 20 is mounted on a hollow aluminum arrow shaft 26.

Each vane 34 lies on a plane which radiates from the longitudinal central axis 36 of the cylindrical body 22. In this particular example there are three vanes spaced 120° from each other. This is the almost universally accepted configuration for arrow fletchings, though others are conceivable and would be covered by the claims of this patent.

Typically the internal diameter of the cylindrical body 22 is slightly smaller than the external diameter of the arrow shaft 26. The elasticity of the plastic fletching then holds it snugly onto the arrow shaft.

Figure 4:
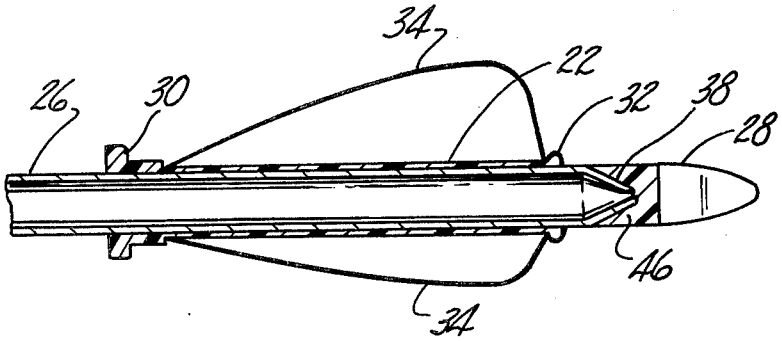
FIG. 4 is a cross-sectional view of the assembly of FIG. 2 taken along the line 4—4 in FIG. 3.

FIG. 4 is a longitudinal cross-section of a fletching assembled onto an arrow shaft 26. The cylindrical body 22 again fits snugly over the hollow arrow shaft. The rearward annular form 32 and the forward annular form 30 have not as yet been removed. At the rearward end of the arrow shaft, the walls of the cylindrical shaft decrease in diameter to form a cone 38. The nock 28 has a conical cavity 46 at one end. This conical cavity is adapted to accept the conical rearward end of the arrow shaft and is glued to it.

Figure 8:
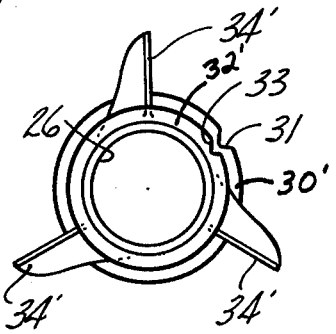
FIG. 8 is a rear view of the fletching mounted on an arrow with the nock removed and showing alignment notches.

FIG. 8 shows a rear view of a fletching mounted on an arrow shaft. This differs from the fletching of FIG. 3 in that there are two notches, one on each of the annular forms. The notch 31 is on the forward annular form 30'. The notch 33 is on the rearward annular form 32'. The notches are offset by three degrees on the fletching, so that when they are aligned the vanes 34' will be skewed three degrees. The helical skewing gives the arrow a spin which further stabilizes the flight of the arrow. Dimensions are slightly distorted in FIG. 8 to better show detail.

Figure 6:
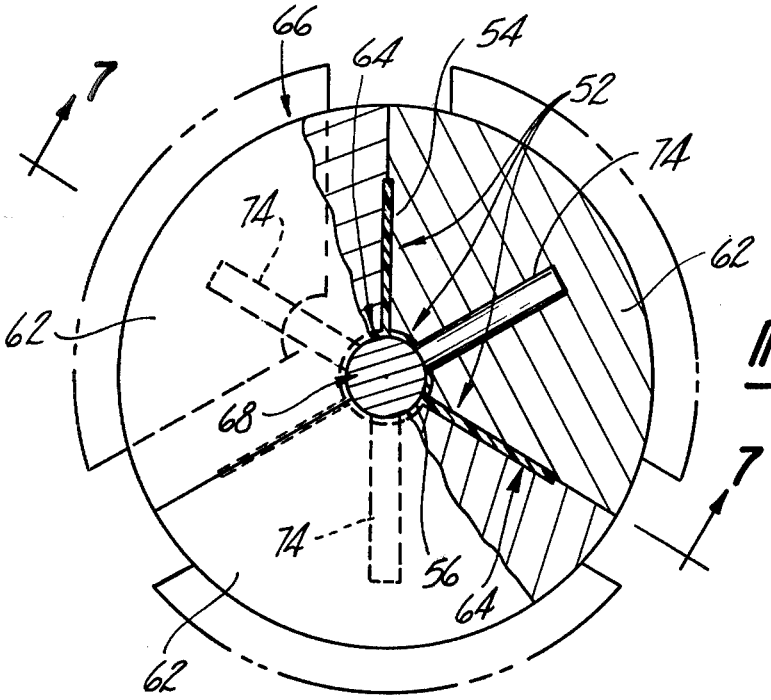
FIG. 6 is a combined end view and cross-section of a mold for making the fletching of this invention.

FIG. 6 shows a partial cut-away view of a mold body assembly 66 as seen from along its longitudinal axis. The mold body assembly is composed of three mold body sections 62 which are movable. When fit together with the core rod 68 they form a cavity 52 which takes the shape of the arrow fletching; that is, the cavity 52 has a vane portion 54, a cylindrical body portion 56, a rearward annular form portion 58 and a forward annular form portion 60. These can be seen in FIG. 7. The mold body section 62 are disassembled to release the fletching after it has been molded.

During the molding process the mold body sections are held together in a holder so that the pressure of the injected plastic does not push them apart. The holder may take any one of a number of common configurations well known in the art.

Pins 74 extend from the mold body sections 62 and touch the core rod 68. In this particular embodiment there are 3 pins midway between the vane portions of the cavity in each mold body section. The pins are rigidly fixed to the mold body sections. This may be done by any of several means. The holes in the mold body section may be dead-ended and the pins fit into the dead-ended holes. This is the specific example shown in FIGS. 6 and 7. The holes in the mold section and the pins may be threaded. The pins would then be threaded into the mold body sections. As another alternative the holes in the mold body section may be drilled through the whole section, and the holder into which the mold body assembly fits would hold the pins as well as the mold body sections.

Figure 7:
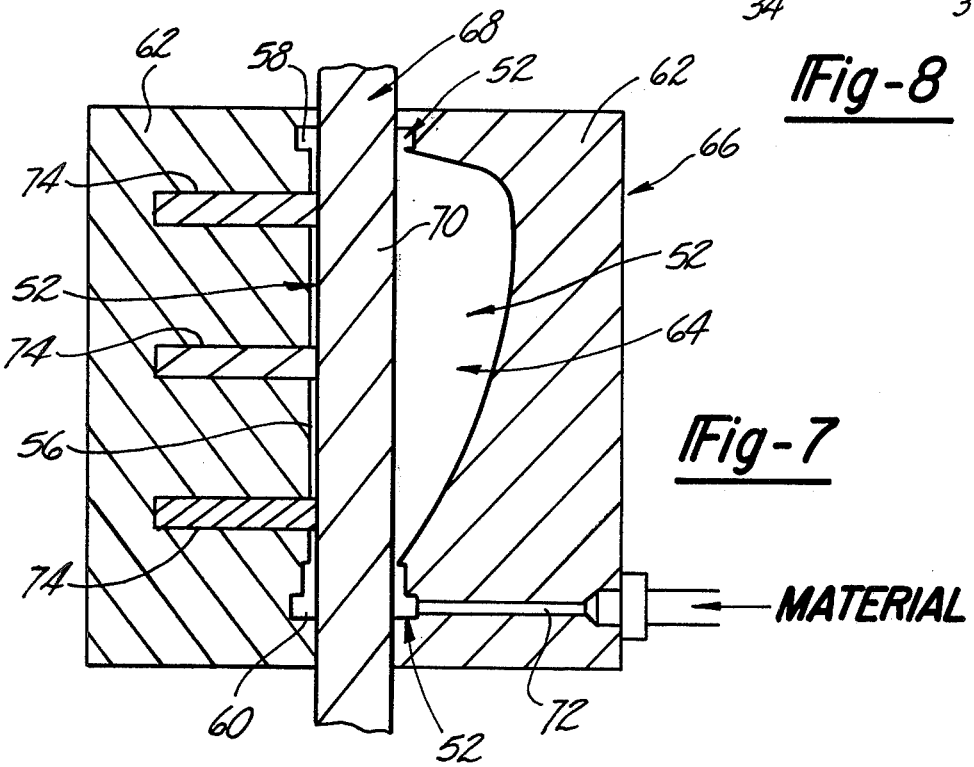
FIG. 7 is a cross-section of the mold of FIG. 6 taken along the line 7—7.

FIG. 7 shows a longitudinal cross-section of the mold body assembly 66. The internal cavity 52 is bounded by the internal surface of the mold assembly 64 and the external surface of the core rod 70, and forms a void of the same shape as the arrow fletching previously described. The mold body contacts the core rod 68 at either end and forms a seal to prevent plastic from escaping from the mold cavity. A plastic material preferably urethane is heated and injected into the mold cavity through the injection passage 72. The plastic is heated to lower its viscosity. At room temperature it is a solid. It is heated to as high a temperature as possible to lower the viscosity of the plastic, but not so high a temperature as to initiate decomposition. The mold body itself is held at a temperature lower than the melting point of the plastic. It acts as a heat sink to cool and solidify the plastic once the cavity is filled.

Due to the thermal decomposition limits, the plastic as it is injected still has a very high viscosity. This, coupled with the fact that the mold cavity is small, narrow and thus difficult to fill, requires that a great deal of pressure be placed on the injected plastic.

The coupling of the high viscosity of the plastic and high pressure as it enters the mold would displace the core rod assembly if it were not for the pins 74. The pins hold the core rod assembly 68 in the center of the mold cavity during the molding process. Because the pins touch the central core rod, the finished fletching has perforations 24 in the cylindrical body 22 as shown in FIGS. 1 and 2.

Rather than molding the fletching onto a central core rod, in OEM applications the fletching may be molded directly onto the arrow shaft. In this embodiment a hollow aluminum arrow shaft would be substituted for the core rod assembly 68 in the molding process. This converts a two step process into one step.

Because of the tremendous molding pressures the typical hollow aluminum arrow shaft would collapse unless it were supported internally by a support rod. Because the support rod would need to be inserted and removed during the molding process the end of the arrow shaft could not be conical, as shown at 38 in FIG. 4, but must be open.

Figure 5:
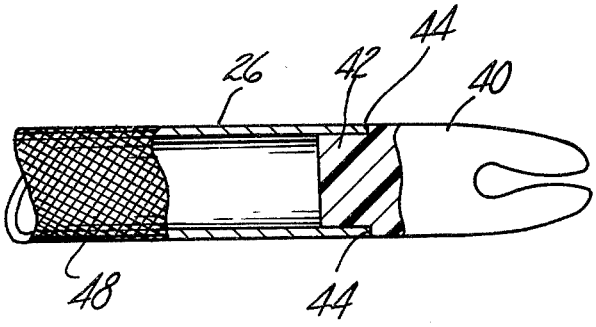
FIG. 5 is a detailed cross-section of an alternative means for nocking of an arrow.

An alternate method of nocking an arrow with an open ended shaft is shown in FIG. 5. The alternate type nock 40 has a smaller diameter portion 42 which fits inside the arrow shaft 28 and can be glued therein. The nock also has a ridge 44 around its periphery which fits snugly against the end of the cylindrical arrow shaft thus forming a smooth continuous outer surface.

Also shown in FIG. 5 is the knurling 48 on the arrow shaft 26. In one example, the fletching is molded directly onto the arrow shaft and there is no opportunity to apply glue. The knurling serves to give the fletching a grip on the shaft. This prevents the fletching from slipping off the shaft during use; for example when passing through a target.

While we have shown and described several embodiments in accordance with the present invention, it is obvious that the same is not limited thereto but is susceptible to numerous changes and modifications as known to those skilled in the art, and we therefore, do not wish to be limited to the details shown and described herein but intend to cover all such changes and modifications as are encompassed by the scope of the appended claims.

I claim:

1. A method for fletching arrows comprising the steps of:

molding a unitary fletching device so as to form a hollow cylindrical body with radial vanes and being adapted to fit snugly over the rearward end of an arrow shaft by virtue of said hollow cylindrical body being formed with an internal diameter slightly smaller than the external diameter of said arrow shaft and having forward and rearward ends; and forward and rearward integral concentric annular forms;

gripping the forward annular form and pulling it and the fletching device onto the arrow shaft;

concurrently gripping the rearward annular form and pushing it and the fletching device onto the arrow shaft; and thereafter removing the forward and rearward annular forms by severing them from the cylindrical body.

2. A method as described in claim 1 further comprising:

in the molding step, the molding of a first notch in the rearward annular form, said notches being displaced from one another by a radial angle; and aligning the two notches so as to form a helical skew in the radial vanes, prior to removing the forward and rearward annular forms.

3. A method of fletching arrows comprising the steps of:

assembling a mold to define an elongated cylindrical cavity having a diameter slightly greater than that of an arrow shaft and having a plurality of circumferentially spaced thin radial extensions which define fletching shaped vanes contiguous with the mold cavity, the mold further defining cavity areas of increased diameter at the forward and rearward extremities of the cylindrical cavity such that the resulting molded article exhibits increased diameter annular forms at the longitudinal extremities thereof;

locating a core within the mold cavity and longitudinally aligned and concentric therewith such that the void area of the cavity assumes a hollow cylindrical shape with an inner diameter slightly smaller than the outer diameter of said arrow shaft and having contiguous thin radial vanes, said locating step including the disposition of radially extending pins circumferentially between said vanes to hold the core in the concentric location;

injecting fluid plastic into the cavity to form the integral combination of a hollow cylinder with radially extending fletching shaped vanes, the core locating pins forming a plurality of aligned perforations along the cylindrical body and between each of said fletching shaped vanes;

removing the molded plastic article from the mold;

sliding the molded plastic article onto an arrow shaft by gripping the forward annular form and pulling it and the fletching device onto the arrow shaft, and concurrently gripping the rearward annular form and pushing it and the fletching device onto the arrow shaft; and thereafter removing the forward and rearward annular forms by severing them from the cylindrical body.

* * * * *